US005450809A

United States Patent [19]

Melton

[11] Patent Number: 5,450,809

[45] Date of Patent: Sep. 19, 1995

[54] HUNTING/FISHING ACCESSORY

[76] Inventor: Donnie R. Melton, 483 N. Palestine, Natchez, Miss. 39120

[21] Appl. No.: 106,273

[22] Filed: Aug. 12, 1993

[51] Int. Cl.[6] ..... B63B 7/00

[52] U.S. Cl. ..... 114/353; 114/363

[58] Field of Search ..... 114/343, 364, 352–354, 114/357, 344, 363; 280/414.1–414.3, 47.331, 47.24, 789; 405/3–7

[56] References Cited

U.S. PATENT DOCUMENTS

| | | | |
|---|---|---|---|
| 2,659,464 | 11/1953 | Sweetman | 114/353 |
| 3,222,100 | 12/1965 | Lindzy | 280/47.24 |
| 3,594,834 | 7/1971 | Steensen | 114/353 |
| 3,821,825 | 7/1974 | Bailey | 114/363 |
| 3,996,635 | 12/1976 | Wilkes et al. | 114/352 |
| 4,366,769 | 1/1983 | Lingeman | 114/352 |
| 4,512,275 | 4/1985 | Drumm | 114/343 |
| 4,768,454 | 9/1988 | Selken | 114/353 |
| 4,781,397 | 11/1988 | Burn | 280/47.331 |

FOREIGN PATENT DOCUMENTS

| | | | |
|---|---|---|---|
| 2614004 | 10/1988 | France | 114/344 |
| 1336307 | 11/1973 | United Kingdom | 114/353 |

*Primary Examiner*—Edwin L. Swinehart

*Attorney, Agent, or Firm*—Pravel, Hewitt, Kimball & Krieger

[57] ABSTRACT

A camping, fishing or hunting cargo container is formed of two identical clam shell sections hinged on one side and folded together to form a light weight load which can be easily moved by manpower on a portage trailer. The portage trailer can also be adapted for towing by a truck or by a four wheeler off road vehicle. The cargo container can be opened and locked open against the hinges to form a light two man fishing boat; alternately the hinge pins can be pulled to form two one man pirogues or canoes. Internal shelving in the sections provides storage of camping and hunting supplies or, when the unit is used as a boat, provides davits and internal storage compartments.

2 Claims, 3 Drawing Sheets

FIG. 1
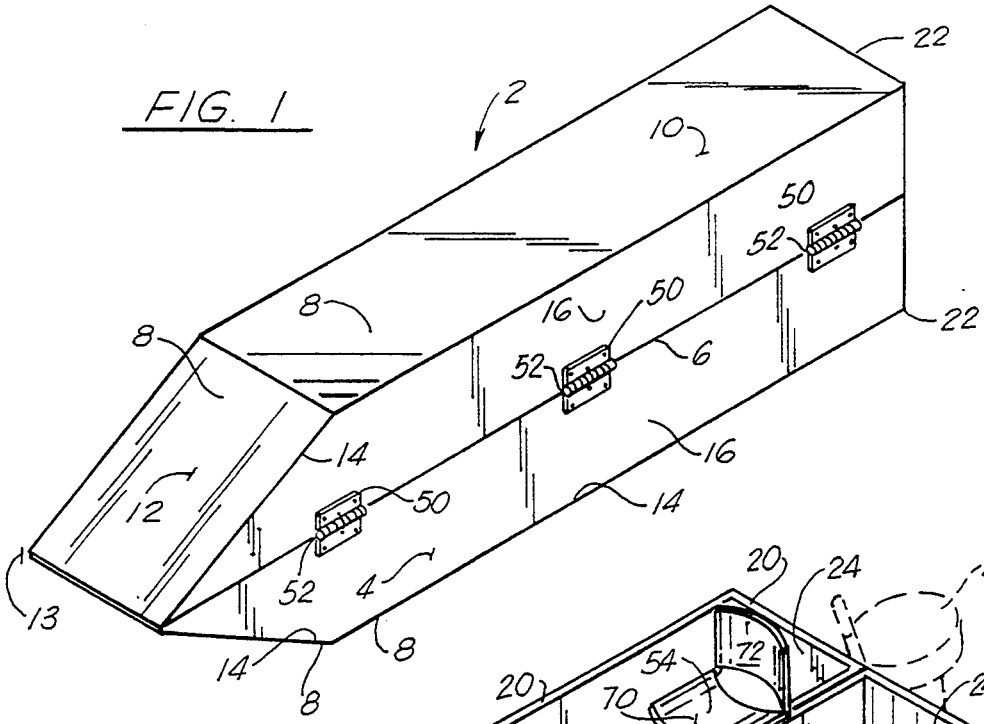
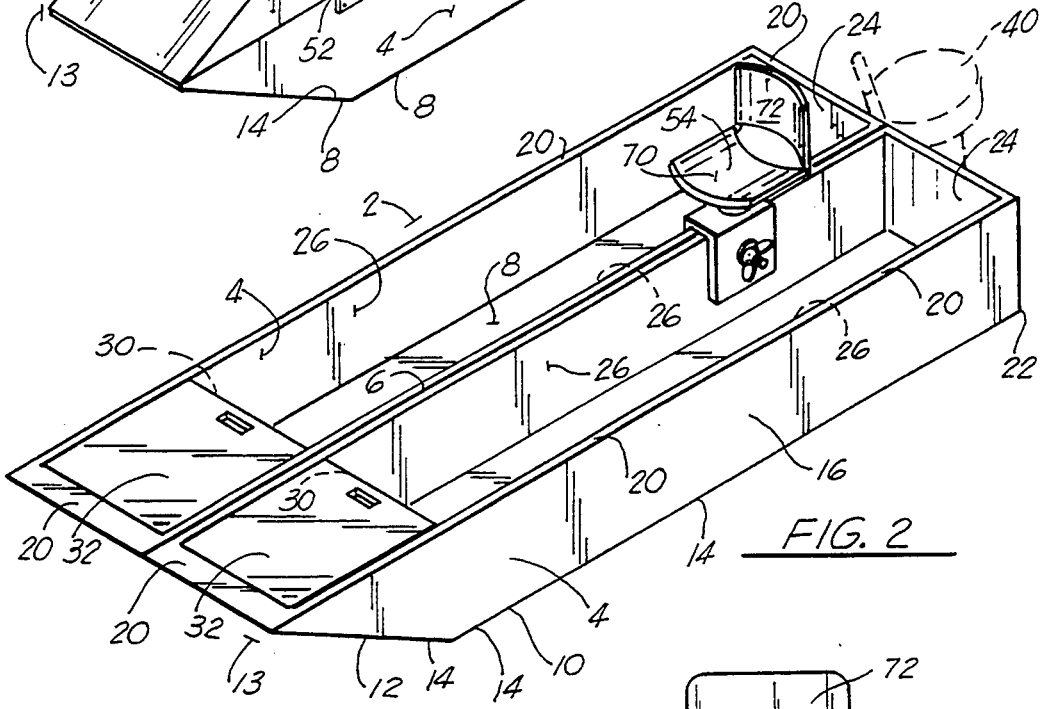
FIG. 2
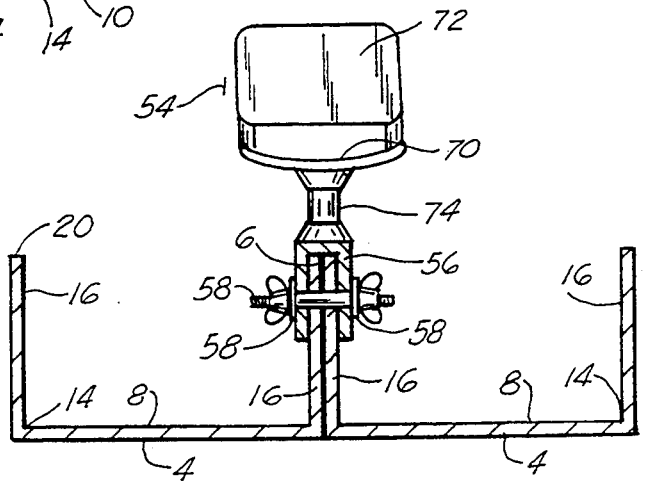
FIG. 3

HUNTING/FISHING ACCESSORY

BACKGROUND OF THE INVENTION

This invention relates to the field of hunting and fishing field equipment, especially to portage equipment and portable boats.

Hunting an fishing trips into wilderness areas, especially wetlands areas, poses a significant problem to the hunter; he or she needs a convenient way to transport more equipment and supplies than may be back packed, and he/she needs a way of transposing a boat. The prior art shows several examples of boats used as cargo carriers, including folding boats, but none that may conveniently portaged; that is, easily moved by man power alone through the brush and wilderness.

U.S. Pat. No. 4,180,881 to Speranza is typical of these folding boat patents. Speranza discloses a folding boat, hinged on a athwartship line so that the bow folds back over the stern. The unique aspect of this patent is that a removable spring support for trailer wheels is provided, and a receiving recess is molded into the stern of the boat to hold a towbar, all to adapt the boat for towing behind a vehicle.

U.S. Pat. No. 3,090,973 to Levinson is an earlier folding boat patent, where the boat has an integral trailer frame which, when the boat is folded, is a trailer for towing, and, when the boat is unfolded, provides the stiffening frame to hold the boat open. A screw adapter fastens the bow section to the trailer tongue. The trailer wheels are retractable into provided wells into the stern section of the boat.

U.S. Pat. No. 3,684,139 Johnson shows a folding boat which can be used as a cart top luggage carrier. Also note that this patent shows the concept of using a sectional hinge with removable pin, locking the hinge sections together to fasten together the sections of the boat.

U.S. Pat. No. 2,422,930 to Rutledge is an early folding boat. Rutledge uses through bolts and wing nuts to secure the two halves of the boat, and converts the boat to a trailerable form by clamp on wheel and bumper clamp assemblies.

U.S. Pat. No. 3,175,234 to Kutsi shows a folding boat, which uses a winch and cable assembly to pull the boat into an unfolded position and maintains the cable under tension to hold the boat open.

U.S. Pat. No. 2,664,577 to Sanborn discloses and claims a clamp on wheel and axle assembly to convert a folding boat to a trailerable assembly. Sanborn also discloses a variant for a standard (non-folding) boat which includes a towbar and frame for supporting the boat.

U.S. Pat. No. 3,097,371 to Rough discloses a folding boat. Rough addresses directly the use of the folded boat as a cargo carrier, disclosing a boat upper rim shape and constriction so that the folded boat has a sloped forward face, with the hinge area sealed against water or rain and a gasket between the upper and lower halves to seal the closed boat as a cargo container.

U.S. Pat. No. 2,548,274 to Van Oeveren shows a folding boat with a single, permanently attached retractable rear wheel to permit towing of the folded boat.

Each of these prior art patents shows a trailerable unit, or a truck mounted unit; none address the problem of portaging such a boat through the wilderness.

SUMMARY OF THE INVENTION

The invention discloses a camping, fishing or hunting cargo container which is formed of two identical clam shell sections hinged on one side and folded together to form a light weight load which can be easily moved by manpower on a portage trailer. The container is easily moved by one man, and has a flat rear section so that it may be stood on end and opened to serve as a convenient storage and packing container.

The portage trailer can also be adapted for towing by a four wheeler off road vehicle.

The cargo container can be opened and locked open against the hinges to form a light fishing boat; alternately the hinge pins can be pulled to form two one man pirogues or canoes. Internal shelving in the sections provides storage of camping and hunting supplies or, when the unit is used as a boat, provides davits and internal storage compartments.

It is thus an object of the invention to disclose a combined cargo container and boat which is easily moved through the wilderness to a hunting or fishing site by man power alone.

It is a further object of the invention to disclose a portable boat that is easily portaged, yet supports up to two fishermen or hunters with their equipment.

It is a further object of the invention to disclose a convenient boat which may be both man portaged or towed behind an off road vehicle.

It is a further object of the invention to disclose a unit which may serve as a cargo container, a portable storage container for hunters or fishermen, and a boat for up to two men.

It is a further object of the invention to disclose a unit which serves as a in camp storage locker, yet is easily portaged by manpower to a wilderness location.

These and other objects of the invention may be readily seen from the detailed description of the invention which follows.

BRIEF DESCRIPTION OF THE FIGURES

FIG. 1 is a view of the closed container.

FIG. 2 is a view of the container opened as a boat.

FIG. 3 is a section through the opened container showing the seat assembly.

DETAILED DESCRIPTION OF THE INVENTION

Figure 4:
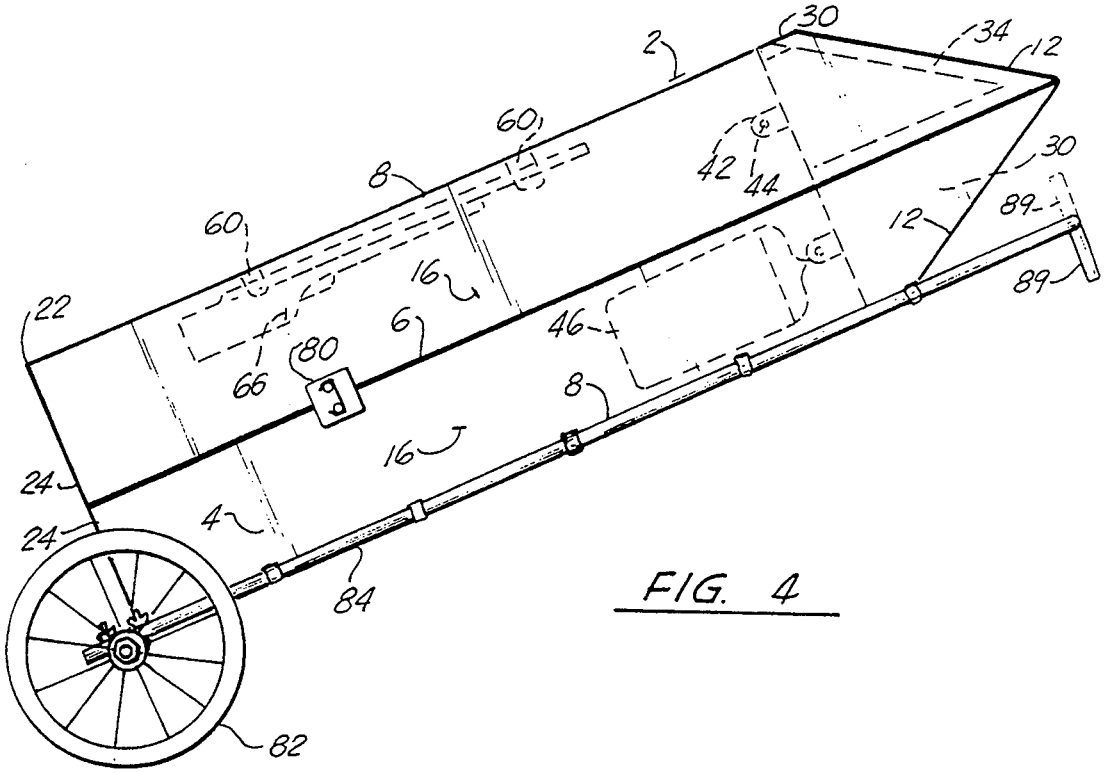
FIG. 4 is a view of the container on a trailer.
Figure 5:
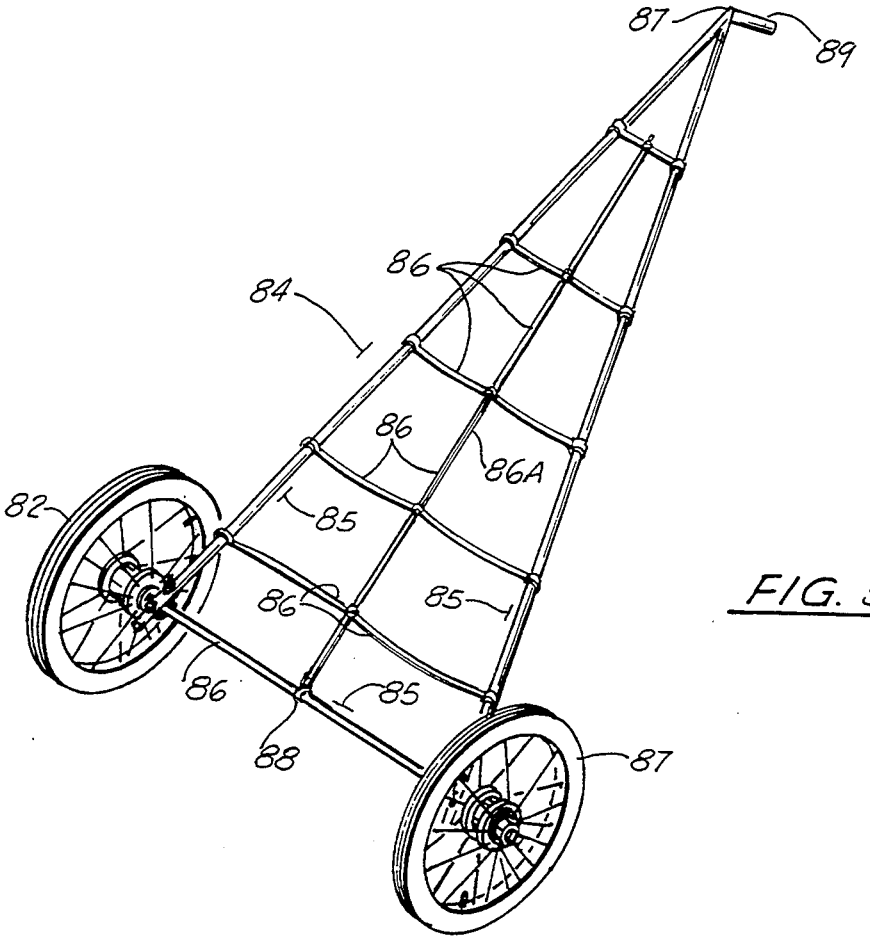
FIG. 5 is a view of the trailer.
Figure 6:
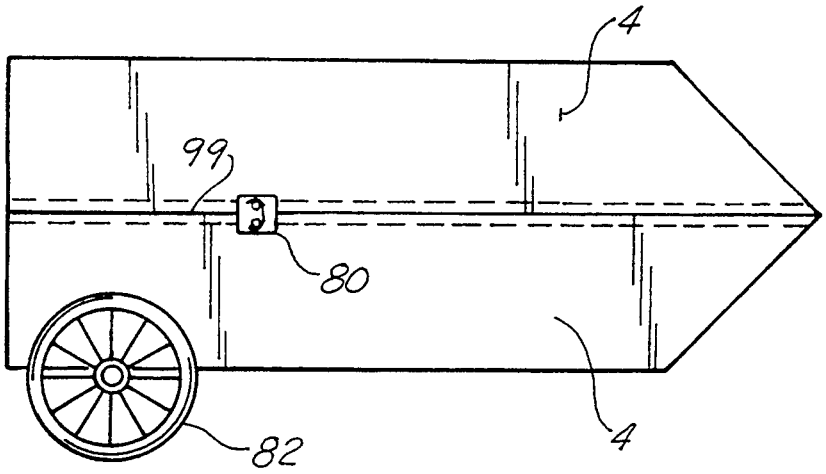
FIG. 6 is a side view of the alternate wheel mounting.
Figure 7:
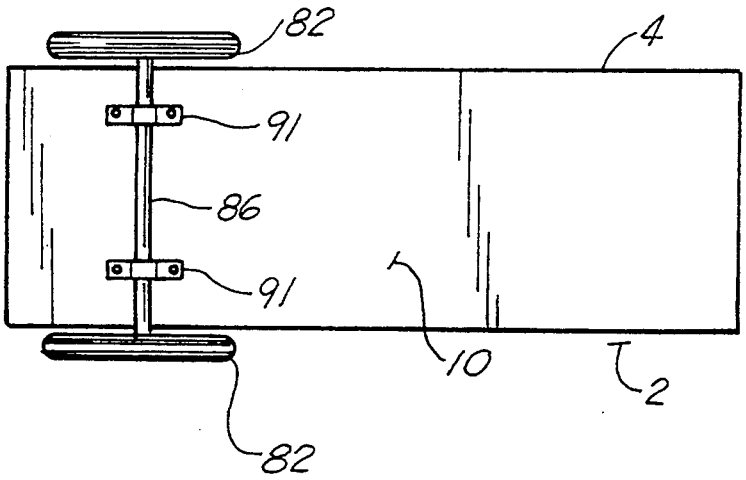
FIG. 7 is a section showing the alternate wheel mounting.

The figures disclose the outer form of the inventive container. The container 2 is a closed symmetrical unit formed of two identical half shells 4 which are joined along their outer edges 6. Each half shell 4 is identical in outer shape. A base 8 is formed of a continuous sheet having a flat bottom surface 10, continuously faired into a curved nose end 12; the resulting shape is like that of a ski, with the tip or nose end 12 turned upwardly.

The side edges 14 of the base 8 are attached to side pieces 16 which form closed sides to the half shell 4, the sides 16 having flat upper edges 20 which extend parallel to the flat bottom surface 10, extending rearward from the nose 12 to the rear edge 22 of the bottom surface 10. A rear piece 24 fitted to the side pieces 16 and the rear edge 22 closes the half shell 4, forming a closed container compartment having a curved bow 12 and level even upper edges 20.

A lengthwise removable sheet 99 between the half shells 4 extends from the bow to the stern, and serves to form a removable closure for the compartments.

The base 8 and the side 16 and rear 24 pieces may be made of plywood, joined with screws and glue or of plastic, preferably filled over a foam core. The inner surface 26 of the sides 16 may additionally have foam inserts or lining or wood blocks may be added. It is desirable that some combination of such foam or wood be added to provide positive floatation to the half shell so that it remains afloat even if swamped. This permits the half shells 4 to meet the currently existing regulatory standards for a boat.

Additionally, within the half shell 4 may be placed various interior compartments 30 as are desirable for storage. For example, the bow section 13 may be walled off, and the resulting compartment 30 lined with insulating quantities of insulation such as a foam 34. This forms a convenient fish or bait storage well, or an ice chest for holding cold foods. Such a compartment 30 should have a closable lid 32 which is also insulated and may be fastened in place to hold contents in the compartment whether the shell 4 is flat or vertical. Such a lid 32 may be hinged to the compartment 30, held closed by latches, or multiple latches may be placed around the edges of the compartment 30 to hold the lid 32 and contents in place during movement of the half shell 4.

Other interior provisions for cargo carrying may be equally provided in the half shell 4. A gun rack 60 or fishing rod rack for holding down guns 66 or fishing tackle may be molded into or fastened to the bottom sheet 8 or sides 16 of the shell 4. A battery hold-down and electric trolling motor 40 hold-down may be provided in the rear of the shell 4. Brackets 42 and rods 44 for hanging support may be mounted to the rear wall of the storage well or compartment 30. Clothing on hangers 46 or other equipment may be supported from such a rod 44.

Two identical such half shells 4 are placed side by side, and connected by hinges 50 so that they can fold together around the upper edge 20 of the adjacent sides 16. Preferably, the mounting hinges 50 have removable pins 52; removing the pins 52 permits the half shells 4 to be separated into two independent units; normally the pins 52 remain inserted and the two shells form a single unit, the inventive storage and portage container 2.

When the two shells 4 are joined together and are open, they are supported in the open position by a seat assembly 54. This assembly comprises an inverted U clamp 56 section which tightly slides down over the two adjoining side pieces 16 of the two shells 4; a through bolt 58 passes through provided holes in the U clamp 56 and the side pieces 16 clamping the two sides 16 and the seat clamp 56 firmly together. A gasket 59 of any soft gasket material, rubber or plastic, seals the bolt hole against leakage.

A standard field seat base 70 and back assembly 72 is then pivotally mounted to the top of the U clamp assembly 56. Such a seat 54 can be a folding or fixed metal frame having a seat cushion 70 and a back cushion 72 of any convenient design. The seat 54 should be mounted on a rotating base 74 and the base 74 is fastened to the U clamp 56 top by screws or rivets.

With the seat 54 installed, the open shells 4 form a boat capable of supporting one person in comfort for fishing or hunting, with sufficient buoyancy for a dog or desirably extra cargo. Alternately, the two shells 4 can be separated by pulling the hinge pins 52; in this condition, the two shells 4 form two independent pirogues, each of which can support a man. Alternately, one shell 4 can be left at camp for storage, and the other forms a one man pirogue for fishing or boating.

When not used for boating, the two shells 4 can be stood vertically on the rear ends 24. When opened, they form a vertical storage container for all camping, hunting or fishing gear, including clothing, supplies, and equipment.

Each shell is typically 5 to 8 feet long and 2 to 3 feet wide. These sizes are determined primarily by the need to obtain sufficient displacement for each half shell 4 to adequately serve as a one man pirogue. Thus a size and depth adequate for a typical person and associated load, say 250 to 300 pounds, with remaining freeboard to prevent easy swamping, is desirable. The container therefore is typically 5 to 8 feet long; 2 to 3 feet wide and 2 to 3 feet thick. Adequate space for almost any conceivable combination of supplies and equipment for one to two hunters or fishermen is clearly available.

The closed container 2 is a convenient size and, when closed, is easily locked closed by lamps or latches 80. Such latches are readily found for closing outdoor storage containers, and no particular latch is considered preferable. The mounting of the latches depends on the material of the shell, some form of reinforcement being advisable for a fiberglass shell and some form of sealing against leakage and rot being advisable for a plywood shell.

The container 2 is conveniently portaged by providing wheels 82 for the boat. In one embodiment, a separate man trailer 84 is provided; this permits the container 2 to be conveniently moved, but no container space is consumed in storing wheels 82 and axles. The trailer 84 is constructed of a triangular frame 85, the base 83 being a axle supporting at its two ends relatively large diameter light weight wheels 82, such as bicycle wheels. The frame 85 is made of light tubular metal tubing, preferably aluminum. Rigidity is provided to the frame 85 by a plurality of webbing straps 86 tightly strung across the frame 85, holding the tubing sections together. A lengthwise strap 86A runs form the apex 87 of the frame 85 to the centerline 89 of the base 83, further stiffening the frame 85. The resulting trailer 84 is very light, and strong. The frame 85 and straps 86 form a flat surface for supporting the container 2.

In an alternative embodiment, an axle 81 is secured to the bottom 10 of one shell 4 by U-straps 91. Bicycle wheels 82 are removable fastened to the ends of the axle for easy portaging of the container over broken ground.

At the apex 87 of the frame 85 is a tow or portage handle 89. The apex ends 87 of the two side frame tubes are flattened, forming two overlaid flat sections. A vertical leg 89 is mounted to the flattened section by either a threaded bolt through the flattened section, or by providing a threaded hole in the flattened section to which the leg 89 may be secured by a threaded end. This leg 89 is of a length approximately equal to the radius of the trailer wheels 82. Normally the leg 89 extends downward. In this position, the leg 89 supports the trailer 84 in a level position. The leg 89 also provides a convenient handle for moving the trailer by hand. The leg 89 may, however, be removed and mounted from above the flattened section; in this position, the leg 89 forms an attaching lug, permitting the trailer 84 to be attached to the tow ring of a typical four wheel off road vehicle for towing.

Also, if the wheels are removed, the container 2 may be conveniently placed on the top of a vehicle or in a truck bed for easy movement.

It can thus be seen from this description that the invention is of a container which serves equally for towing camping or hunting equipment; as a boat in wetlands or for fishermen or hunters in the wilderness, and as a means for portaging hunting or fishing equipment into the wilderness. It provides all the storage, including ice storage, needed for such uses in one conveniently unified package,easily moved and set up by one person. It minimizes the effort required for a wilderness stay, yet provides all that a camper could need.

It should be apparent that the form of this invention is capable of many variations, and the invention is not therefore limited to the specific unit describes but extends to the equivalents of the elements claimed.

I claim:

1. A unit for hunting or fishing comprising:

two enclosed half shells, each having an angled nose section, each hinged along one side to the other, each half shell serving as storage containers;

means for holding the two half shells open along the hinged sides, whereby said open half shells become a boat;

said means being separable, permitting each said half shell to form an independent boat;

wherein said means for holding comprises:

a U-clamp, fitting down over said hinged sides, holding said sides adjacent to one another;

a through hull through bolt fastening said U-clamp through said sides;

a pivoting seat affixed to the top of said U-clamp.

2. A unit for hunting or fishing comprising:

two enclosed half shells, each having an angled nose section, each hinged along one side to the other, each half shell serving as storage containers;

means for holding the two half shells open along the hinged sides, whereby said open half shells become a boat;

said means being separable, permitting each said half shell to form an independent boat;

a triangular frame;

a base of said triangular frame serving as an axle, a wheel on each end of said axle;

interlaced webbing interconnecting the sides of said triangular frame, stiffening said frame;

at least one strap extending from an apex of said triangular frame to a center point on said base, stiffening said frame;

a removable vertical leg at the apex of said triangular frame;

said vertical leg having a position mounted below the apex whereby it serves as a supporting leg and handle;

said vertical leg having position mounted above the apex, whereby it is adapted to secure said trailer to an off road vehicle tow ring.

* * * * *